US005495819A

United States Patent [19]

Marion

[11] Patent Number: 5,495,819

[45] Date of Patent: Mar. 5, 1996

[54] ENDOTHERMIC GAS GENERATOR FOR USE IN A DEVICE PROPULSION

[76] Inventor: Frank A. Marion, 4707 W. Harmont Ave., Glendale, Ariz. 85302

[21] Appl. No.: 209,634

[22] Filed: Mar. 9, 1994

[51] Int. Cl.[6] ..... B63B 1/00

[52] U.S. Cl. ..... 114/238; 149/41; 149/19.1

[58] Field of Search ..... 114/238, 239; 149/19.1, 19.6, 41

[56] References Cited

U.S. PATENT DOCUMENTS 4,619,722 10/1986 Marion ..... 149/41

5,149,384 9/1992 Marion ..... 149/19.1

*Primary Examiner*—Jesus D. Sotelo

*Attorney, Agent, or Firm*—Ellsworth R. Roston; Charles H. Schwartz

[57] ABSTRACT

An enclosure has stationary walls and a ram dividing the enclosure into first and second sections and movable in a particular direction to enlarge the first section and reduce the second section. A device (e.g. a projectile) is disposed in the second section for expulsion by the ram from the enclosure. Exothermic material, preferably on a hollow stationary support within the first section, is combustible to produce solids not deleterious to the enclosure walls and gases expansible to move the ram in the particular direction. Such material may include an oxidizer (e.g. perchlorate, preferably ammonium perchlorate), a binder-reducing agent, preferably organic (e.g. hydroxy-terminated or carboxy-terminated polybutadiene), an additive (e.g. powdered aluminum) to increase the combustion energy, an additive (e.g. iron oxide) to increase the combustion rate and an additive (e.g. potassium perchlorate) to modify the burning rate slope. Their relative weights may be: $NH_4ClO_4$-74.2, polybutadiene-15.3, Al-1.5, FeO-2.0, $KClO_4$-7.0. Endothermic material (e.g. a metal hydrate or hydroxide) preferably lining the ram interior periphery protects the ram. Such material, preferably aluminum trihydrate ($Al(OH)_3$), decomposes at the combustion temperature of the exothermic material to limit the enclosure temperature. Half of the $Al(OH)_3$ may be mixed with an epoxy and the other half with a polyamide resin. The two (2) halves may be mixed and then applied to the ram inner periphery. The decomposition products from the endothermic material and the combustion products from the exothermic material react to produce gases which are soluble in water or non-reactive in air if not soluble in water.

53 Claims, 4 Drawing Sheets

COMPOSITION AND CONCENTRATION OF EXOTHERMIC AND ENDOTHERMIC MATERIALS AND OF COMBUSTION AND DECOMPOSITION PRODUCTS AND TEMPERATURE OF COMBUSTION AND OF GASEOUS EXHAUSTS

| CHEMICAL INGREDIENT | EXOTHERMIC MATERIAL | 1/2 EXO 1/2 ENDO | 1/4 EXO 3/4 ENDO | 1/8 EXO 7/8 ENDO |
|---|---|---|---|---|
| BINDER | 15.3 | 15.3 | 15.3 | 15.3 |
| Fe O | 2.0 | 1.0 | 0.5 | 0.25 |
| AL | 1.5 | .75 | .375 | .1875 |
| $KCLO_4$ | 7.0 | 3.5 | 1.75 | .875 |
| $NH_4 CLO_4$ | 74.2 | 37.1 | 18.55 | 9.275 |
| **CHEMICAL INGREDIENT** | **ENDOTHERMIC MATERIAL** | | | |
| $AL(OH)_3$ | 0 | 42.35 | 63.525 | 74.1075 |
| $T_C$@1000 psi = °f = | 4929 | 1776 | 1134 | 533 |
| $T_E$@14.7 psi = °f = | 2199 | 1022 | 567 | 205 |
| PRODUCTS OF COMBUSTION AND DECOMPOSITION AND RELATIVE AMOUNT | | | | |
| $H_2 O$ | 1.22088 | .77862 | 1.20997 | <1.49799>(ℓ) |
| $H_2$ | .49823 | .85605 | .06831 | 0 |
| HCℓ | .58141 | .29073 | .14538 | 0 |
| CO | .51886 | .19105 | .00050 | 0 |
| $CO_2$ | .51086 | .63252 | .38043 | <.16871> SOL |
| $N_2$ | .32140 | .16341 | .08451 | <.00568> SOL |
| KCℓ | .05051 | .02525 | .01263 | <.00630> SOL |
| $AL_2 O_3$ | .02779 | <.28535>C | <.41413>C | <.47849>C |
| $FeCℓ_2$ | .02501 | .01189 | .00624 | 0 |
| $CH_4$ | 0 | .20615 | .46647 | <.33672> SOL |
| C | 0 | 0 | <.18232>C | <.52430>C |
| HCℓ | 0 | 0 | .14538 | 0 |
| $NH_4 Cℓ$ | 0 | 0 | 0 | <.07888> SOL |

FIG. 1

ENDOTHERMIC GAS GENERATOR FOR USE IN A DEVICE PROPULSION

This invention relates to apparatus for launching weapons, decoys and other devices from enclosures such as tubes. The invention particularly relates to apparatus which launches such weapons, decoys and other devices from tubes without damaging the tubes and without generating fluids which will indicate to an enemy that the weapon, decoy or other device has been launched from the tube.

When hot gasses are discharged from a first pressure vessel via a nozzle and are exhausted into a second pressure vessel, the resultant apparatus is designated a nozzle-controlled gas generator. Nozzle-controlled gas generators are used to fill and pressurize a particular volume for various purposes such as launching weapons, decoys and other devices. Normally, the devices are stored in the tubes prior to their launching and are ejected from the tubes upon their launching. For example, the devices may be torpedoes which are launched from a sub-surface vessel such as a submarines or they may be mines which are launched from a sub-surface vessel as by a propellent. The propellent enters the mine which rises to the water surface because of the gas buoyancy. After a time delay, the gas is released and the mine is flooded with water. The mine then sinks to the bottom of the sea. Alternatively, the device may be a buoy which initially rises to the surface of the sea as by the introduction of the propellant, sends a coded message after a particular delay and then sinks to the bottom of the sea.

Nozzle-controlled gas generators are noisy because gases reach sonic velocity in the throat of a nozzle and expand to supersonic velocities downstream from the throat of the nozzle. Supersonic gas flow creates shock waves as the expanded gas is reflected from surrounding interfaces such as air, water or solid objects. Supersonic shock waves and the turbulent flow created by such shock waves create loud noises. Examples are the sonic boom of passing aircraft or missiles flying at supersonic velocities. Sonic booms are undesirable when they are created in the vicinity of an enemy, because they help the enemy to locate the aircraft or missile.

Sometimes a solid propellant burns within a given volume to fill and pressurize that volume with hot gases and the only resistance to the expansion of such gases is provided by the weight and inertia of the device being launched plus the resisting pressure and drag of the external medium. Under such circumstances, the burning rate of the propellant is controlled by the pressure generated to overcome the resisting force. Such apparatus is designated a work-controlled gas generator. Gas flow within the work-controlled gas generator is sub-sonic. This eliminates the formation of shock waves and the creation of turbulent gas and noise. The gas is confined within the launching tube to produce a quiet launching system. If the generated gas were exhausted externally into air or water, the expanding gas would produce turbulence or noise.

The gas in a work-controlled gas generator may be confined within the launching tube by generating the gas behind a piston or ram which is moved by the gases down the launching tube between the generated gases and the device (e.g. the torpedo) propelled from the tube. However, the piston or ram is stopped before it reaches the end of the launching tube. The stopping device can be a suitable braking arrangement which also seals the forward end of the tube to prevent gas leakage.

A work-controlled gas generator contains enough propellant to eject the heaviest payload at a designed exit velocity when opposed by a maximum resisting force. When the payload is reduced so as to reduce the resisting force, a reduced amount of propellant is consumed in performing the work required to launch the payload. This causes the excess amount to be burned after the payload is rejected. Since the total amount of propellant is ultimately burned, the final operating pressure within the launching tube is essentially constant.

After the payload has been launched, a launching tube filled with hot gases at elevated gas pressures is no longer an asset. If the gases are released into air, they produce noise. If secondary combustion occurs between the released gases and atmospheric oxygen, flame and additional noise may be produced. The flame is undesirable because it is visible for a considerable distance and the noise is undesirable because it identifies where the launching tube is located. If the gases are released into water, they will produce a trail of bubbles if they are not soluble in water. The noise from the bubbles will reveal the position of the launching apparatus to the enemy. Furthermore, prolonged containment of the hot gases in the tube may be detrimental to the tube. This may preclude reuse or recycling of the launching tube.

All of the difficulties discussed in the previous paragraph have existed in the launching apparatus of the prior art. For example, some of the gases produced in the combustion of the propellants of the prior art have not been soluble in water and others have combusted in air. Furthermore, they have damaged the walls of the launch tube so that the tubes cannot thereafter be reused or recycled. The difficulties discussed in the previous paragraph have been known to exist for some time. Considerable thought, research and effort have been devoted to provide launching apparatus which will overcome these difficulties. In spite of such considerable thought, research and effort such difficulties still exist.

This invention provides launching apparatus which resolves the difficulties discussed in the previous paragraph. It includes an exothermic material which combusts to produce gases and solids not deleterious to the launching tube. The gases expand at the combustion temperature to move the piston or ram in a direction to expel the payload from the tube. Furthermore, after the exothermic material has combusted, endothermic material in the launching apparatus decomposes to reduce the temperature in the tube to a value where the launching tube cannot be damaged even over a prolonged period of time. The combination of the exothermic material and the endothermic material also produces gases which are soluble in water or non-reactive in air if not soluble in water.

In one embodiment of the invention, an enclosure has stationary walls and a ram dividing the enclosure into first and second sections and movable in a particular direction to enlarge the first section and reduce the second section. A device (e.g. a projectile) is disposed in the second section for expulsion by the ram from the enclosure. Exothermic material, preferably on a hollow stationary support within the first section, is combustible to product solids not deleterious to the enclosure walls and gases expansible to move the ram in the particular direction. Such material may include an oxidizer (e.g. perchlorate, preferably ammonium perchlorate) a binder, preferably organic (e.g. hydroxy-terminated or carboxy-terminated polybutadiene), an additive (e.g. powdered aluminum) to increase the combustion energy, an additive (e.g. iron oxide) to increase the combustion rate and an additive (e.g. potassium perchlorate) to modify the burning rate slope. Their relative weights may be: $NH_4ClO_4$-74.2, polybutadiene-15.3, Al-1.5, FeO-2.0, $KClO_4$-7.0.

Endothermic material (e.g. a metal hydrate or hydroxide) preferably lining the ram interior periphery protects the ram. Such material, preferably aluminum trihydrate ($Al(OH)_3$) decomposes at the combustion temperature of the exothermic material to limit the enclosure temperature. Half of the $Al(OH)_3$ may be mixed with an epoxy and the other half with a polyamide resin. The two (2) halves may be mixed and then applied to the ram inner periphery. The decomposition products from the endothermic material and the combustion products from the exothermic material react to produce gases which are soluble in water or non-reactive in air if not soluble in water.

IN THE DRAWINGS:

FIG. 1 is a chart or table which allows (a) the compositions of exothermic and endothermic materials included in this invention and provided in different relative proportions, (b) the products of combustion of the exothermic material and of decomposition of the endothermic material and (c) the temperature of the combustion and of the exhaust gases for each of these different proportions;

Figure 3:
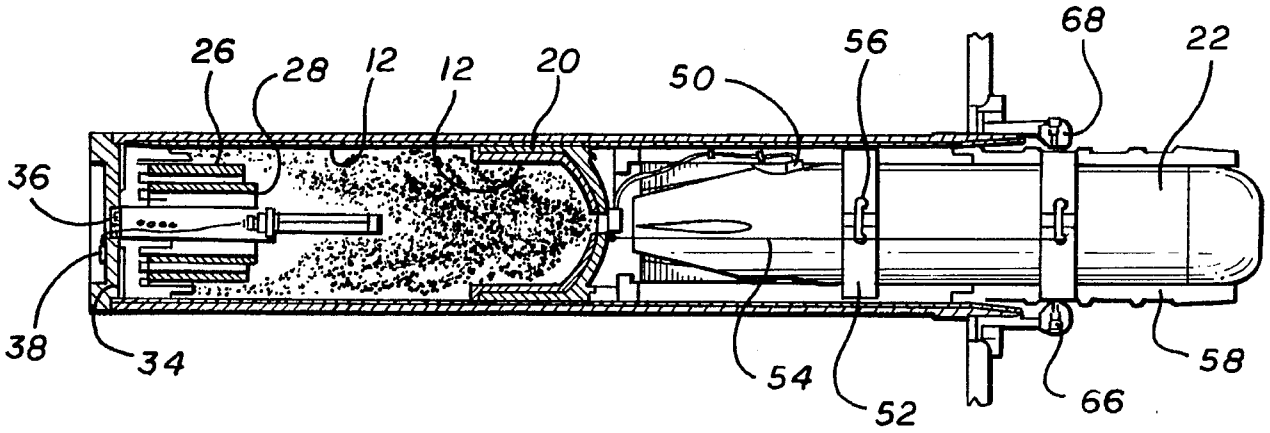
FIG. 3 is a simplified schematic sectional view similar to that shown in FIG. 2 and illustrates the combustion of the exothermic material in the enclosure.
Figure 4:
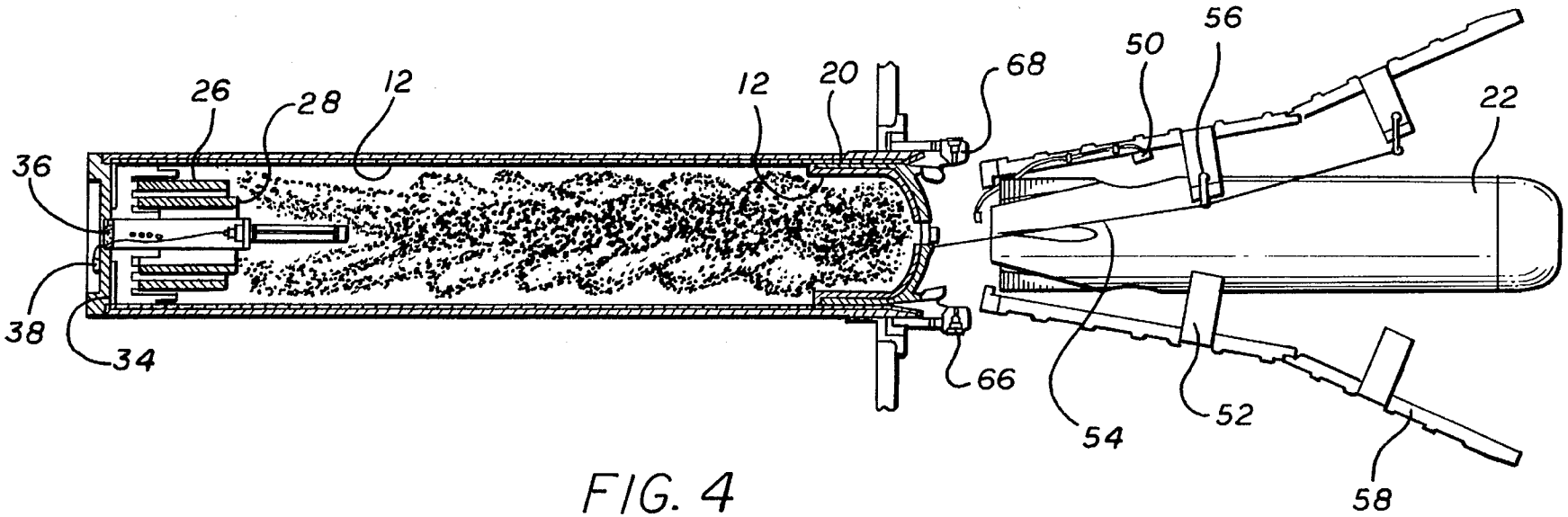
Figure 5:
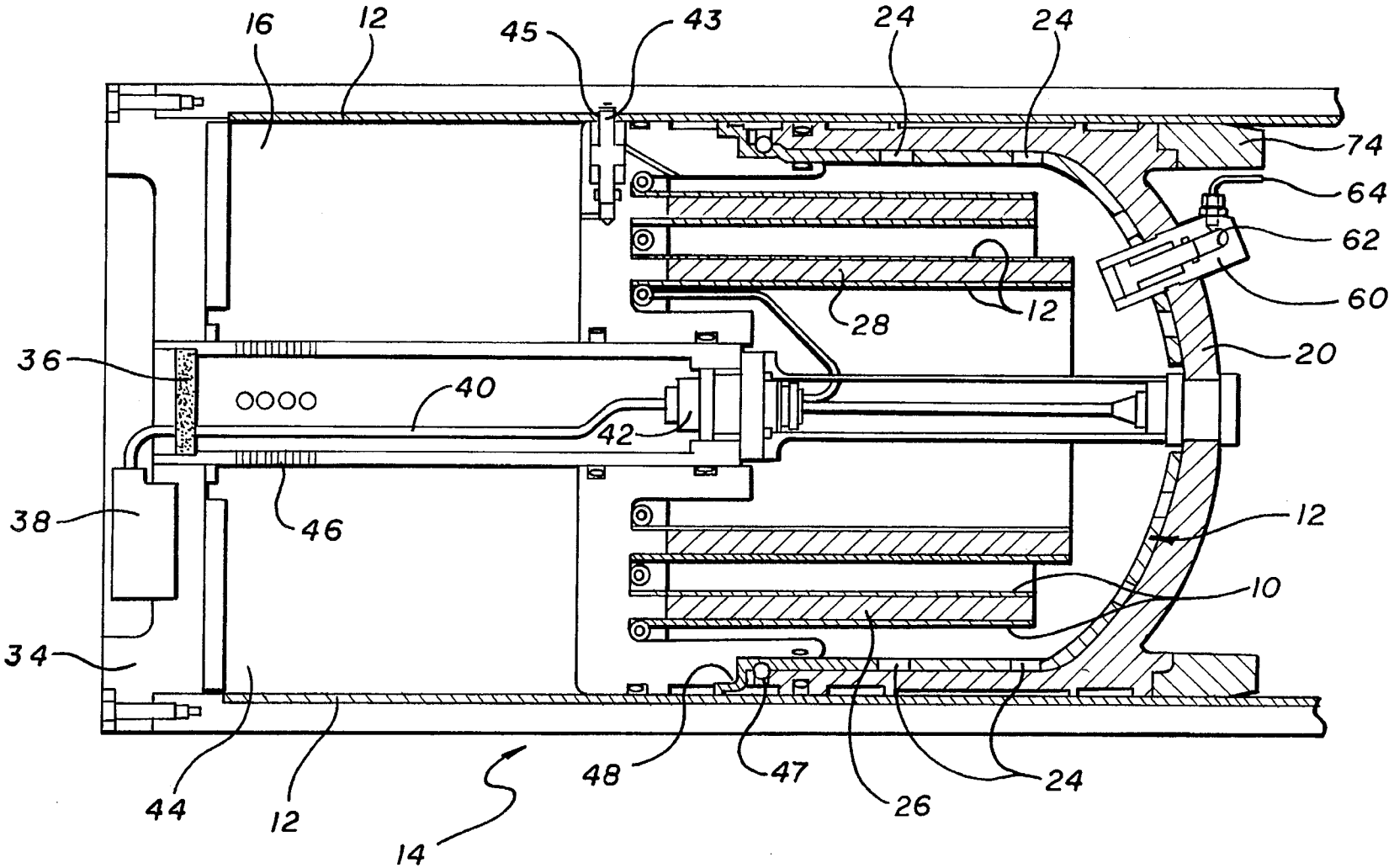

FIG. 4 is a simplified schematic view similar to that shown in FIG. 3 and illustrates the propulsion of the projectile from the enclosure by the hot gases generated in the combustion of the exothermic material; and FIG. 5 is an enlarged fragmentary sectional view of the portion of the apparatus incorporating the exothermic and endothermic materials and shows the portion of the apparatus in additional detail.

Figure 2:
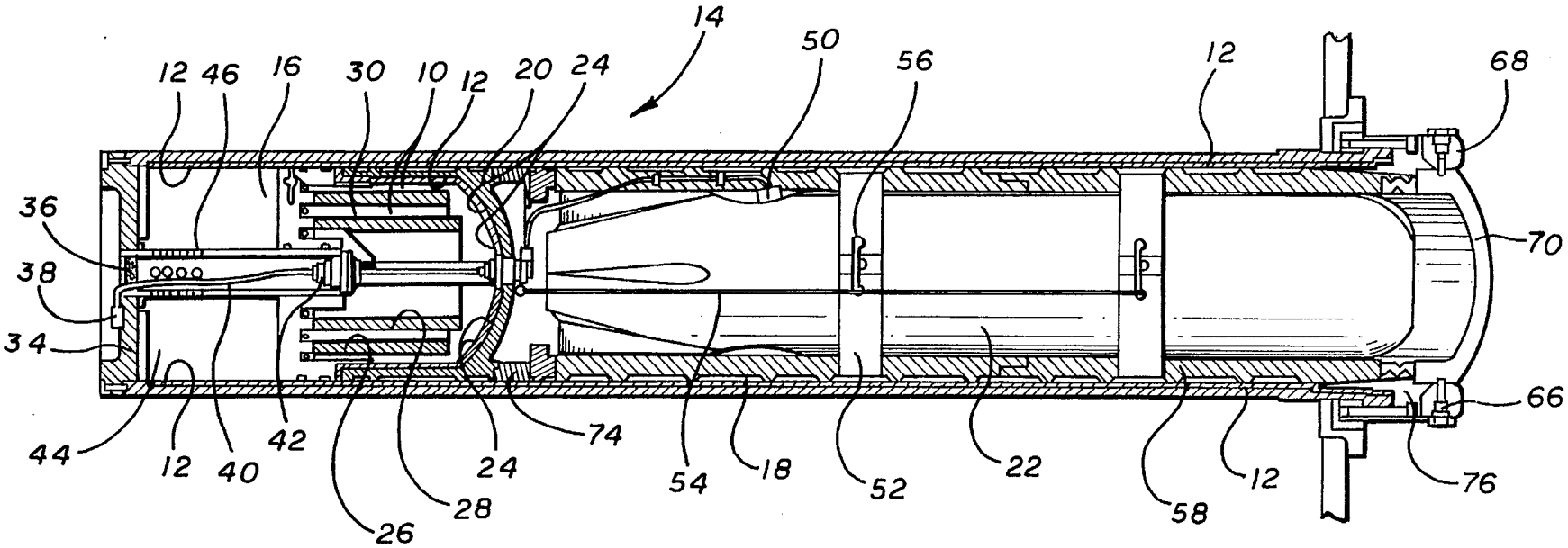
FIG. 2 is a sectional view of apparatus incorporating the exothermic and endothermic materials in an enclosure and incorporating a device such as a projectile for propulsion from the enclosure when the exothermic material combusts.

In one embodiment of the invention, exothermic material generally indicated at 10 in FIGS. 2 and 5 is provided. The composition of the exothermic material 10 is shown in FIG. 1. The exothermic material 10 includes an oxidizer which is preferably a perchlorate. The preferred perchlorate for the oxidizer is ammonium perchlorate with an approximate percentage by weight in the mixture of seventy four and six tenths percent (74.6%). A material constituting both a binder and a reducing agent is also disposed in the exothermic material 10. The material is preferably organic. A preferred embodiment of the combined binder and reducing agent is carboxy-terminated polybutadiene or hydroxy-terminated polybutadiene. The polybutadiene may have a suitable weight such as approximately fifteen and three tenths percent (15.3%) in the exothermic material 10.

A material may be included in the exothermic material 10 to increase the combustion energy. Preferably this material may also be included in the exothermic material 10 to increase the burning rate. Preferably this material is ferric oxide ($Fe_2O_3$). The ferric oxide may have a suitable percentage by weight such as approximately two percent (2.0%) in the exothermic material 10. The exothermic material 10 may also include a material to modify the burning rate slope. This material may preferably be a metallic perchlorate such as potassium perchlorate ($KClO_4$). Preferably this material has a percentage by weight such as approximately seven percent (7.0%) in the exothermic material 10.

The combustion temperature of the exothermic material 10 is almost five thousand degree Fahrenheit (5000°) as shown in FIG. 1. The exhaust products include water ($H_2O$), carbon dioxide ($CO_2$), hydrogen ($H_2$), hydrogen chloride (HCl), nitrogen ($N_2$), carbon monoxide (CO), potassium chloride (KCl), aluminum oxide ($Al_2O_3$), ferrous oxide ($Fe_3O_4$) and ferrous chloride ($FeCl_2$). Carbon dioxide, carbon monoxide, hydrogen chloride and potassium chloride are soluble in water but solubility does not occur instantaneously. Therefore, some bubbles would be created if these gases were released into water. Furthermore, hydrogen and carbon monoxide would cause a secondary combustion of oxygen in air. Both hydrogen and nitrogen are permanent gases insoluble in water and would thus create bubbles in water.

This invention includes an endothermic material, generally indicated at 12 in FIGS. 2 and 5, which operates on the gases generated by the combustion of the exothermic material to convert these gases to a form soluble in water and non-reactive in air. The composition of the endothermic material 12 is shown in FIG. 1. Preferably the endothermic material 12 has properties of decomposing at the temperature of combustion of the exothermic material 10. The exothermic material may preferably include a hydroxide or a hydrate of a metal. Depending upon the temperature in the enclosure for the exothermic material 10 and the endothermic material 12, the hydrates or hydroxides of the metal decompose to form steam (if the temperature is above the boiling point of water at the elevated pressures in the enclosure) or water (if the temperature is below the boiling point of water at the elevated pressures in the enclosure). The endothermic material 12 is aluminum trihydrate ($Al(OH)_3$ or barium hydroxide oxyhydrate ($Ba(OH)_2 \cdot 8 H_2O$). These materials may be in powdered form.

The decomposing material may be provided in the endothermic material 12 in a suitable concentration such as approximately seventy percent (70%) by weight. The material constituting the remaining thirty percent (30%) by weight may be suitable binders and curing agents. For example, the material constituting thirty percent (30%) may be provided by an epoxy designated by the trademark "Epon" and a polyamide designated by the trademark "Versamid". Half of the decomposing material (e.g. $Al(OH)_3$ may be mixed with the epoxy and the other half of the decomposing material may be mixed with the polyamide with equal parts by weight of the epoxy in one mixture and the polyamide in the other mixture. When it is desired to provide the endothermic material 12, the two (2) mixtures are combined. This causes the epoxy to become cured.

The exothermic material 10 and the endothermic material 12 may be provided in various proportions by weight in an enclosure. This may be seen from FIG. 1 which constitutes a chart or table showing in successive columns the effects of increasing amounts of the endothermic material 12 in the enclosure. In each column in the table of FIG. 1, one hundred grams (100 g) of a combination of the exothermic material 10 and the endothermic material 12 are provided. In the top rows of the first column in FIG. 1, the different chemicals in the exothermic material 10 are listed. These rows are designated as "CHEMICAL INGREDIENT". The materials constituting the exothermic material 10 are followed by a listing of aluminum trihydrate ($Al(OH)_3$), which is used as the endothermic material. The epoxy and the polyamide are not listed in the first column of FIG. 1.

Two rows in FIG. 1 are provided to indicate temperatures. The upper one of these rows indicates the temperature of combustion of the exothermic material 10 in the enclosure at a pressure of approximately one thousand pounds per square inch (1000 psi). The lower row indicates the temperature at which gases are exhausted from the enclosure at a pressure of approximately fourteen and seven tenths pounds per square inch (14.7 psi). Below the rows indicating the combustion and exhaust temperatures is a sub-heading designated as "PRODUCTS OF COMBUSTION AND DECOMPOSITION AND RELATIVE AMOUNT". The rows below this sub-heading indicate the products resulting from the combustion of the exothermic material 10 and the decomposition of the endothermic material 12.

The second column in FIG. 1 indicates the composition of the exothermic material 10 and the endothermic material 12, the combustion and exhaust temperatures and the products of combustion and decomposition when there are one hundred grams (100 g.) of the exothermic material 10 and zero grams (0 g.) of the endothermic material 12 in the enclosure. As will be seen, the combustion temperature is approximately 4929° F. at the pressure of approximately one thousand pounds per square inch (1000 psi) and the exhaust temperature is approximately 2199° F. at the pressure of fourteen and seven tenths pounds per square inch (14.7 psi). As will be seen, the exhaust temperature is quite high, sufficiently high to damage the walls of the enclosure if the time for the production of the exhaust temperature is prolonged.

As will be seen in the second column of FIG. 1, gases (e.g. $H_2$ and $N_2$) insoluble in water and gases (e.g. $Co_2$, CO, HCl and KCl) soluble in water are produced. However, the solubility of $CO_2$, CO, HCl and KCl does not occur instantaneously. As a result, the hydrogen and carbon monoxide will burn in air and the hydrogen and nitrogen and other gases will produce bubbles. Furthermore, considerable amounts of hydrogen (almost 0.5 moles) carbon monoxide (more than 0.5 moles) and nitrogen (almost ⅓ mole) are produced, particularly relative to the total amount of gases produced in the combustion of the exothermic material 10. This is not desirable since the combustion of the exothermic material 10 identifies where the combustion is occurring.

The third column in FIG. 1 indicates the various parameters when each of the exothermic material 10 and the endothermic material 12 (not including the epoxy and the polyamide) constitutes fifty grams (50 g.) in the total of one hundred grams in the enclosure. As will be seen, the binder-reducing agent (e.g. polybutadiene) remains constant but all of the other ingredients in the exothermic material decrease by one half (½) from the amount shown in the second ($2^d$) column of FIG. 1. The amount of the aluminum trihydrate ($Al(OH)_3$) is shown as slightly more than forty two grams (actually 42.35 g). The amount of the aluminum trihydrate ($Al(OH)_3$) corresponds to the sum of all of the ingredients (except for the polybutadiene binder-reducing agent) in the exothermic material.

The temperature of combustion of the material shown in the third column of FIG. 1 is approximately 1776° F. and the temperature of the exhaust gases is approximately 1022° F. As will be seen, these temperatures are considerably below the corresponding temperatures in the second column of FIG. 1. The amount of hydrogen ($H_2$) in the resultant gases is considerably increased from that shown in column 2 but the amounts of carbon monoxide (CO) and nitrogen are considerably decreased from the amounts shown in FIG. 1. The result is that the total amount of hydrogen, carbon monoxide and nitrogen in column 3 of FIG. 1 is slightly less than the total amount of these chemicals in column 2 of FIG. 1. However, a significantly decreased amount of steam is produced with the composition shown in column 3 than with the composition shown in column 2. Aluminum oxide is produced as a solid as indicated by brackets and the letter "C" following the brackets.

In the fourth column in FIG. 1, one fourth (¼) of the material in the enclosure is exothermic and three fourths (¾) of the material in the enclosure is endothermic. All of the exothermic materials (except for the polybutadiene binder-reducing agent) are accordingly reduced by one half (½) from the amount shown in the third column and the amount of the aluminum trihydrate is increased by one half (½) from that shown in the third column. The temperature of combustion is accordingly reduced to approximately 1134° F. and the temperature of the exhaust gases is approximately 567° F., both temperatures being considerably below the corresponding temperatures in the third column of FIG. 1.

Furthermore, low amounts of hydrogen (0.068 moles), carbon monoxide (0.0005 moles) and nitrogen (0.0845 moles) are produced with the ratio of the exothermic material 10 and the endothermic material 12 in the fourth column of FIG. 1. The total of these gases is approximately only 0.153 moles. However, approximately 2.356 moles of gases are produced in the enclosure. The total of the three (3) gases ($H_2$, CO and $N_2$) thus represents less than only seven percent (7%) of the total amount of gases produced.

There are other advantages to the combination of material represented in the fourth (4th) column of FIG. 1. For example, more than one half (½) of the gases produced constitutes steam (1.210 moles) and the gas with the next highest concentration constitutes methane ($CH_4$) with a concentration of approximately (0.466 moles). Both steam and methane are soluble in water. Thus a negligible amount of the gases produced from the combustion of the exothermic material 10 and the decomposition of the endothermic material 12 in the enclosure produces bubbles in water or burns in air. Aluminum oxide and carbon are produced as solids as indicated by brackets and the letter "C" following the brackets.

The combination of the materials shown in the fourth (4th) column of FIG. 1 is accordingly desirable in ejecting a device such as a torpedo, a mine or a buoy from an underwater vessel such as a submarine. Such a combination of materials is also advantageous because much of the carbon atom is produced in the form of carbon which is a solid not deleterious to the enclosure and because a considerable amount of aluminum oxide is in the form of a solid which is not deleterious to the enclosure.

The last column in FIG. 1 relates to a combination in which the exothermic material 10 (except for the polybutadiene binder-reducing agent) constitutes approximately one eighth (⅛) by weight and the endothermic material 12 (except for the epoxy and the polyamide) constitutes approximately seven eighths (⅞) by weight. When this combination is provided, the temperature of combustion is approximately 533° F. and the temperature of the exhaust from the enclosure is approximately 205° F. This is less than the boiling point of water, as indicated by brackets and the letter "l" for the amount of $H_2O$ produced by the combination of material in the last column of FIG. 1. As will be seen by the brackets surrounding the various numbers relating to the amounts of the products produced from the combustion of the exothermic material 10 and the decomposition of the endothermic material 12, two (2) of the products ($Al_2O_3$ and C) are in the form of solids, as indicated by brackets and the letter "C" following the second bracket. This results from the low exhaust temperature. Furthermore, the amount of carbon dioxide and methane produced in the last column of FIG. 1 totals about one half (½) of a mole. Both of these gases are soluble in water as indicated by brackets followed by the abbreviation "SOL".

The total amount of gases produced in the last column of FIG. 1 is approximately two (2) moles. This is a decrease from the approximately 3.7 moles of gases produced in the second column of FIG. 1. Furthermore, substantially all of the gases produced in the last column of FIG. 1 are converted to water or are soluble in water. This allows the launching tube to be flooded with sea water after the torpedo, mine or buoy has been expelled from the launching tube. This restores the same buoyancy to the launching system as is provided when the torpedo, mine or buoy is in the launching tube. The stability of the sub-sea vessel when submerged under the water is accordingly maintained. Furthermore, the torpedo is able to travel in a straight line after it has been expelled from the enclosure.

It will be appreciated that various hydroxides and hydrates may be used as the decomposing ingredients in the endothermic material 12 and that these different ingredients have different decomposing temperatures. For example, aluminum tri-hydrate (also known as aluminum hydroxide) decomposes at 360° C.; barium hydroxide oxyhydrate decomposes at approximately 100° C.; calcium hydroxide decomposes at approximately 580° C.; magnesium hydroxide decomposes at approximately 350° C.; and zinc hydroxide composes at approximately 125° C. The temperature of exhaustion of the gases can accordingly be controlled by selecting the decomposing ingredient or a mixture of the ingredients.

The oxide produced from the decomposition of the hydrate or hydroxide in the endothermic material 12 is a solid. It serves an important function in secondary reactions. In such secondary reactions, it neutralizes acidic products and it converts certain gases to solids by reactions forming solid compounds or water-soluble products. For example, when barium hydroxide oxyhydrate is used as the decomposing ingredient in the endothermic material 12, it decomposes to barium oxide. The barium oxide then reacts with carbon dioxide to form barium carbonate and with hydrogen chloride to form barium chloride.

The enclosure for the exothermic material 10 and the endothermic material 12 is preferably in the form of a cylindrical tube and is generally indicated at 14 in FIGS. 2 and 5. The enclosure 14 is divided into two (2) sections 16 and 18 in FIG. 5 by a ram or piston 20. The ram or piston is movable in a particular direction (such as to the right in FIG. 2) to increase the volume of the first section 16 and to decrease the volume of the second section 18. A device 22 such as a torpedo, mine or buoy is disposed in the second section 18 and is expelled from the second section in accordance with the movement of the ram 20 in the particular direction.

The endothermic material 12 preferably covers the inner periphery of the ram and the launch tube 20 so as to be movable with the ram. The endothermic material 12 also preferably covers the inner surfaces 16 and 18 of the enclosure 14. When the endothermic material 12 is formed as described above, it may be cast, molded, extruded, trowelled, rolled or sprayed upon the surface constituting the inner periphery of the ram 20. The endothermic material 12 protects the ram 20 by thermal decomposition when exposed to hot gases, flame or intense radiant energy. Preferably a sufficient amount of the endothermic material 12 is disposed on the inner periphery of the ram 20 so that some of the material will remain on the ram after the gases in the first section 16 have cooled to the decomposition temperature.

The hydroxides or hydrates in the endothermic material 12 decompose upon the absorption of heat to release water molecules which become converted to steam. The oxide of the parent compound then remains in solid form. The binder formed by the epoxy and the polyamide also decomposes endothermically by pyrolysis to release hydrogen and produce the pyrolitic graphite form of carbon (which is a solid). If an oxygen source is available, some of the hydrogen may react to form water and some of the carbon may react to form carbon monoxide or carbon dioxide. Some of the hydrogen may react with some of the carbon to form methane. When nitrogen is available, some of the hydrogen will react with some of the hydrogen to form ammonia.

Preferably holes 24 are provided in the endothermic material 12 on the inner periphery of the ram 20. The holes 24 become enlarged as the endothermic material 12 decompose. The holes 24 enhance the action of the endothermic material 12 in decomposing because they increase the area of the external surface of the endothermic material. The exothermic material 10 is disposed on the inner and outer peripheries of a hollow support 26 which is preferably in the form of a hollow cylindrical tube. The hollow support 26 is stationary within the first section 16. Additional endothermic material 30 may be disposed on a hollow stationary support 28 which is in the form of a hollow cylindrical tube within the first section 16. The endothermic material 30 may be the same as the endothermic material 12.

The stationary support 28 is preferably radially interior in the first section 16 to the hollow stationary support 26 so that the exothermic material 10 is disposed in a spaced, but sandwiched, relationship between the layers of the endothermic materials 12 and 30. This facilitates the operation of the endothermic materials 12 and 30 in decreasing the temperatures of the products of combustion (including gases and solids) in the first section 16 after the combustion of the exothermic material An end cap 34 is disposed at one end of the enclosure 14 to close the enclosure. A filter 36 is disposed in the end cap 34 at a central position in the end cap to prevent sea creatures from entering into the enclosure 14. An electrical connector 38 is disposed externally of the filter 36 to provide for the introduction of electrical energy to leads 40 which extend through the filter 36 to a firing device such as a squib 42. When the squib 42 is fired by the introduction of electrical energy, it generates gases at elevated temperatures. These gases ignite the exothermic material 10. The construction of the end cap 34, the filter 36, the electrical connector 38, the leads 40 and the squib 42 is well known in the art.

When the exothermic material 10 combusts, it generates gases at an elevated temperature. These gases expand and move the ram 20 to the right in FIG. 2. The movement of the ram is damped by fluid (such as water) in an accumulator 44 and by orifices 46 in the accumulator. As the ram 20 moves to the right, the accumulator 44 is released for movement to the right in FIG. 2 by the creation of pressure from the gases in the first section 16. This pressure forces piston 43 downwardly from a detent 45 in the wall of the enclosure 14. As the ram 20 moves to the right in FIGS. 2–4, it frees pins 47 from detents 48. This frees the ram 20 for continued movement to the right in FIGS. 2–5.

The torpedo 22 is also freed for movement to the right in FIGS. 2–5 by the release of break-away connectors 50 (FIG. 5) coupled to the torpedo. Bands 52 FIGS. 3 and 4 encircle the torpedo 22 at spaced positions along the length of the torpedo. A lanyard 54 extends from the ram 20 to the bands 52 to couple the ram to the bands. The bands 52 may be formed from a pair of separable portions which are coupled together by detachable rods 56. The bands 52 retain fingers 58 which are disposed in the portion 18 of the enclosure 14 radially external to the torpedo 22. Because of the coupling between the ram 20 and the fingers 58 through the lanyard 54 and the bands 52, the fingers and the lanyard and the bands move with the torpedo to the right through the enclosure 14.

A valve 60 (FIG. 5) extends through the ram 20 from a position in the first section 16 to a position in the second section 18. The valve 60 has a piston 62 which moves upwardly and to the right in FIG. 5 in response to the pressure of the gases produced in the first section 16 when the exothermic material 10 combusts. This movement of the piston 62 drives hydraulic fluid in the valve 60 through a tube 64 to release pistons 66. The release pistons are normally disposed in detents 68 (FIG. 2) in a cap 70 at the right end of the enclosure 14. The disposition of the pistons 66 in the detents 68 retains the cap 70 on the enclosure 14 so that the torpedo 22 is retained within the enclosure.

When the hydraulic fluid passes through the tubes 64 to the pistons 66, the pistons 66 are forced out of the detents 68. This releases the cap 70 so that the torpedo 22 is able to move through the second section 18 of the enclosure 14. As the torpedo 22 moves out of the enclosure 14, the lanyard 54 acts on the rods 56 to separate the two (2) halves of the bands 52. Since the lanyard 54 is still coupled to the ram 20, the fingers 58 pivot outwardly to free the torpedo 22 from the fingers when the torpedo leaves the enclosure 14.

Although the torpedo 22 becomes freed to be launched from the enclosure 14, the ram 20 is not freed for movement from the enclosure. This results from the entrapment of an extension 74 on the forward end of the ram 20 by a ramp 76 on the enclosure 20 near the cap 70. The retention of the ram 20 within the enclosure 14 is desirable because it allows the ram 22 and the enclosure 14 to be used more than once. The enclosure 14 and the ram 20 are in a condition to be used more than once since the action of the endothermic materials 12 and 30 instantaneously cools the enclosure and the ram to a temperature below that at which the enclosure and the ram would be damaged.

This invention provides certain advantages over the prior art. It provides for an efficient expulsion of the device such as the torpedo 22 from the enclosure 14. It provides for the instantaneous production of sufficiently low temperatures in the enclosure 14 and the ram 20 so that no deleterious effects are produced on these members by the combustion of the exothermic material 10 in the enclosure. Furthermore, the combination of the exothermic material 10 and the endothermic materials 12 and 30 causes fluids (and particularly gases) to be produced which are soluble in water or are non-reactive in air if they are not soluble in water. The combination of the exothermic material 10 and the endothermic materials 12 and 30 also causes solids to be produced which are not deleterious to the enclosure 14 or the ram 20.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination, enclosure means, exothermic means disposed in the enclosure means and having properties of combusting to produce gases and solid providing no deleterious effect on the enclosure means, and endothermic means disposed in the enclosure means and having properties of decomposing at the heat of combustion of the exothermic means to limit the temperature in the enclosure means to a particular value providing for a re-use of the enclosure means and to convert the gases produced from the combustion of the exothermic means to gases providing no visible indications in water and air.

2. In a combination as set forth in claim 1, means disposed relative to the enclosure means for initiating the combustion of the exothermic means in the enclosure means.

3. In a combination as set forth in claim 1, the enclosure means being defined by walls providing a hollow cavity, the endothermic means being disposed closer to the walls of the enclosure means than the exothermic means.

4. In a combination as set forth in claim 3, means partially defining the enclosure means and dividing the enclosure means into first and second sections movable by the gases produced from the combustion of the exothermic means in the enclosure means to increase the volume of the first section within the enclosure means and to decrease the volume of the second section within the enclosure means.

5. In combination, enclosure means, exothermic means disposed within the enclosure means and including an organic binder, an oxidizer and additives to provide a controlled rate of combustion of the binder and the oxidizer to produce products of combustion including gases and to produce solids not detrimental to the enclosure means, and endothermic means disposed within the enclosure means relative to the exothermic means to decompose from the heat of combustion of the exothermic means and reactive with the products of combustion to produce gases coolable to liquids and providing no visible indications in water and air and to produce materials not detrimental to the enclosure means.

6. In a combination not set forth in claim 5, the oxidizer and the additives including metals, and the endothermic means including a metallic hydrate or hydroxide.

7. In a combination as set forth in claim 5, the endothermic means including a metallic hydrate or hydroxide and further including curable means mixed with the metallic hydrate or hydroxide.

8. In a combination as set forth in claim 5, a ram included in the enclosure means and partially defining the enclosure means and dividing the enclosure means into first and second sections, the ram being movable by the gases produced as a result of the combustion of the exothermic means to increase the volume of the first section in the enclosure means and to decrease the volume of the second section in the enclosure means.

9. In a combination as set forth in claim 8, the oxidizer and the additives including metals, and the endothermic means including a metallic hydrate or hydroxide and also including curable means mixed with the metallic hydrate.

10. In combination, enclosure means, exothermic means disposed in the enclosure means and including an oxidizer and a combustible binder, the exothermic means being combustible to produce solids not adversely affecting the enclosure means and to produce gases, and endothermic means disposed in the enclosure means and including at least one of a metallic hydrate and a hydroxide having properties of decomposing at the temperature of combustion of the exothermic means to reduce the temperature in the enclosure means, after the combustion of the exothermic means, to the temperature of decomposition of the metallic hydrate and to produce solids not adversely affecting the enclosure means and to produce gases providing no visible indications in water and air.

11. In a combination as set forth in claim 10 wherein ram means are disposed in the enclosure means and partially define the enclosure means and divide the enclosure means into first and second sections and are movably disposed to increase the volume of the first section in the enclosure means and decrease the volume of the second section in the enclosure means in accordance with the combustion of the exothermic means and the production of gases from such combustion and wherein projectile means are disposed within the second section of the enclosure means and are operatively coupled to the ram means and are movable with the ram means for expulsion of the projectile means from the enclosure means.

12. In a combination as set forth in claim 11, the ram means having a wall partially defining the enclosure means, the endothermic means being disposed closer to the wall of the ram means than the exothermic means to reduce the temperature of the wall of the ram means to the temperature of decomposition of the at least one of the metallic hydrate and the hydroxide after the initiation of the combustion of the exothermic means.

13. In a combination as set forth in claim 11, means for preventing the ram means from being expelled from the enclosure means after the projectile means have been expelled from the enclosure means.

14. In combination, enclosure means, exothermic means disposed in the enclosure means and including an oxidizer, a binder including hydrocarbons, a material to increase the energy of combustion of the exothermic means and a material to provide a controlled rate of combustion of the exothermic means, endothermic means disposed in the enclosure means and having properties of decomposing from the heat of combustion of the exothermic means to reduce the temperature in the enclosure means to a temperature dependent upon the temperature of decomposition of the endothermic means and the relative amounts of the exothermic means and the endothermic means in the enclosure means, the exothermic means and the endothermic means having properties of forming, when combusted, products which are not deleterious to the enclosure means and which include solids and gases, the endothermic means having properties of reacting, when decomposed, with the products of combustion of the exothermic means to form gases providing no visible indications in water and air and to form solids which are not deleterious to the enclosure means.

15. In a combination as set forth in claim 14, the endothermic means including at least one of a hydrate and a hydroxide of a metal having properties of decomposing to form water and to absorb energy from the heat of combustion of the exothermic means as a result of such decomposition.

16. In a combination as set forth in claim 15, the endothermic means also including a curable binder mixed with the hydrate of the metal and having endothermic properties.

17. In a combination as set forth in claim 16, the binder being formed from a mixture of an epoxy and a polyamide.

18. In a combination as set forth in claim 17, the exothermic means being disposed more internally in the enclosure means than to the endothermic means.

19. In combination, exothermic means including an oxidizer and a combustible binder, enclosure means expansible in accordance with the generation of gases as a result of the combustion of the exothermic means, endothermic means having properties of decomposing at the temperature of combustion of the exothermic means to limit the temperature in the expansible enclosure means after the combustion of the exothermic means in the expansible enclosure means, the exothermic means and the endothermic means having properties of generating fluids including gases which are not deleterious to the enclosure means and which do not produce bubbles in water and do not react in air and of generating solids which are not deleterious to the enclosure means.

20. In a combination as set forth in claim 19, projectile means operatively coupled to the enclosure means for movement in accordance with the expansion of the enclosure means.

21. In a combination as set forth in claim 20, the enclosure means and the projectile means being disposed in a vessel, and means operatively coupled to the enclosure means and the projectile means for providing for the release of the projectile means from the vessel and for the retention of the enclosure means in the vessel.

22. In a combination as set forth in claim 19, the endothermic means having properties of decomposing to produce water and also to produce solids reactive with the fluids generated by the combustion of the exothermic means.

23. In a combination as set forth in claim 22, the exothermic means having properties of combusting to produce non-corrosive and non-erosive solids and to produce fluids reactive with the solids produced by the decomposition of the endothermic means and gases soluble in water.

24. In a combination as set forth in claim 21, the endothermic means having properties of decomposing to produce water and also to produce solids reactive with the fluids generated by the combustion of the exothermic means, the exothermic means having properties of combusting to produce non-corrosive and non-erosive solids at the temperature of decomposition of the endothermic means and to produce fluids reactive with the solids produced by the decomposition of the endothermic means and gases soluble in water.

25. In combination, means defining an enclosure expansible at one end in a particular direction, exothermic means disposed in the enclosure means near the expansible end of the enclosure means and combustible to generate at the temperature of combustion products including gases expansible to produce the expansion of the enclosure means in the particular direction, the exothermic means also having properties of generating during the combustion products including solids which are stable in the enclosure means at reduced temperatures, and endothermic means disposed in the enclosure means and having properties of decomposing at the temperature of combustion to absorb energy and decrease the temperature in the enclosure means to the reduced temperatures, the endothermic means having properties of reacting, when decomposed with the products of combustion to produce fluids providing no visible indications in water and air, the endothermic means being disposed in the enclosure means to prevent the enclosure means from being damaged by the products of combustion.

26. In a combination as set forth in claim 25, the enclosure means including a ram movable in the particular direction to expand the enclosure means, the exothermic means being disposed in the vicinity of the ram to provide for the movement of the ram in the particular direction in accordance with the combustion of the exothermic means, the endothermic means being disposed in the vicinity of the ram to cool the enclosure means in the vicinity of the ram to the reduced temperatures after the combustion of the exothermic means.

27. In a combination as set forth in claim 26, the enclosure means having first walls partially defining the enclosure means and the ram being disposed within the walls for movement in the particular direction within the walls to expand the enclosure means, the endothermic means being movable in the particular direction with the ram, the exothermic means being stationary in the enclosure means.

28. In a combination as set forth in claim 27, the enclosure means being hollow, and the exothermic means being more interior to the hollow configuration of the enclosure means than the endothermic means.

29. In a combination as set forth in claim 28, means extending into the enclosure means from a position external to the enclosure means for initiating the combustion of the exothermic means.

30. In a combination as set forth in claim 29, means defining a compartment in contiguous relationship to the enclosure means, and means disposed within the compartment in contiguous relationship to the ram for expulsion by the ram from the compartment in the particular direction in accordance with the movement of the ram in the particular direction to expand the enclosure means.

31. In combination in an enclosure, a combustible exothermic material including an oxidizer constituting a perchlorate, an organic binder and reducing agent and additives included in the exothermic material for controlling the combustion energy and the combustion rate of the exothermic material upon combustion, and an endothermic material having properties of decomposing upon the combustion of the exothermic material to limit the temperature in the enclosure, the exothermic material and the endothermic material forming solids not deleterious to the enclosure and forming gases providing no visible indications in water and air when the exothermic material combusts and the endothermic material decomposes.

32. In a combination as set forth in claim 31, the endothermic material having properties of decomposing at the temperature of combustion of the exothermic material and of reducing the temperature in the enclosure in accordance with such decomposition.

33. In a combination as set forth in claim 32, the endothermic material including materials selected from the group consisting of hydrates and hydroxides of metals.

34. In a combination as set forth in claim 31, means for supporting the exothermic material, and means for supporting the endothermic material.

35. In a combination as set forth in claim 33, the oxidizer constituting ammonium perchlorate and the binder and reducing agent constituting at least one of hydroxy-terminated polybutadiene and carboxy terminated butadiene and the endothermic material consisting of aluminum trihydrate, the endothermic material having properties of decomposing at the temperature of combustion of the exothermic material to produce water and also to produce solids reactive with the gases generated by the combustion of the exothermic material to produce gases providing no visible indications in water and air, the additives being selected from the group consisting of powdered aluminum, iron oxide and potassium perchlorate.

36. In a combination as set forth in claim 32, the endothermic material having properties of decomposing at the temperature of combustion of the exothermic material to produce water and also to produce solids reactive with the gases generated by the combustion of the exothermic material to produce gases providing no visible indications in water and air.

37. In a combination as set forth in claim 33, the oxidizer constituting ammonium perchlorate and the binder and reducing agent constituting at least one of hydroxy-terminated polybutadiene and carboxy-terminated butadiene and the endothermic material consisting of aluminum trihydrate.

38. In a combination as set forth in claim 31, the additives being selected from the group consisting of powdered aluminum, iron oxide and potassium perchlorate.

39. In combination, an expansible enclosure defined by a stationary wall and a ram movable in a particular direction relative to the stationary wall, the ram having an inner periphery, an endothermic material covering the inner periphery of the ram, an exothermic material disposed in the expansible enclosure in the vicinity of the ram, the exothermic material having properties of combusting to generate solids and gases, the gases being operative at the temperature of combustion to produce a movement of the ram for expanding the enclosure, the endothermic material having properties of decomposing at the temperature of combustion to reduce the temperature in the enclosure and thereby protect the walls of the enclosure from any deleterious effects, the exothermic material and the endothermic material being co-operative, in accordance with the combustion of the exothermic material and the decomposition of the endothermic material, to produce solids not deleterious to the walls of the enclosure and fluids providing no visible indications in water and air.

40. In a combination as set forth in claim 39, additional amounts of the endothermic material also being disposed at an interior position in the enclosure relative to the exothermic material.

41. In a combination as set forth in claim 39, a hollow conduit disposed within the expansible enclosure in the vicinity of the ram, the exothermic material being disposed on the hollow conduit to facilitate the combustion of the exothermic material and the production of gases as a result of such combustion.

42. In a combination as set forth in claim 40, the hollow conduit constituting a first hollow conduit, a second hollow conduit also being disposed at an interior position in the enclosure relative to the first hollow conduit, and the additional amount of the endothermic material being disposed on the second hollow conduit for decomposition to reduce the temperature within the enclosure and to co-operate with the products of combustion of the exothermic material to produce the solids not deleterious to the enclosure and the fluids providing no visible indication in water and air.

43. In a combination as set forth in claim 42, the first and second hollow conduits being disposed in the enclosure near the ram, the first hollow conduit being stationary in the enclosure, the second hollow conduit being stationary in the enclosure.

44. In combination, an enclosure defined by stationary walls and a ram having properties of dividing the enclosure into first and second sections, the ram being movable in the enclosure in a particular direction to increase the volume of the first section and correspondingly decrease the volume of the second section, an exothermic material disposed within the first section of the enclosure and combustible to produce solids and also to produce gases for moving the ram in the particular direction, means disposed within the second section of the enclosure and movable with the ram in the particular direction for expulsion from the second section of the enclosure, an endothermic material disposed within the first section of the enclosure and having properties of decomposing at the temperature of combustion of the exothermic material, the exothermic material and the endothermic material having relative properties and proportions to produce solids and gases which will not deteriorate the stationary walls and the ram of the enclosure as a result of the combustion of the exothermic material, the gases having properties of being soluble in water and not reacting in air.

45. In a combination as set forth in claim 44, means disposed outside of the enclosure and extending into the enclosure for initiating the combustion of the exothermic material.

46. In a combination as set forth in claim 45, means for retaining the ram in the enclosure even after the expulsion of the movable means from the enclosure.

47. In a combination as set forth in claim 45, the endothermic material being selected from a group consisting of a hydroxide and a hydrate of a metal, the exothermic material including an oxidizer constituting a perchlorate.

48. In a combination as set forth in claim 44, the endothermic material being selected from a group consisting of a hydroxide and a hydrate of a metal.

49. In a combination as set forth in claim 44, the endothermic material being attached to the inner surface of the ram for movement with the ram to maintain the temperature of the ram at the temperature of decomposition of the endothermic material.

50. In a combination as set forth in claim 49, the exothermic material being initially disposed within the ram before the movement of the ram in the particular direction and being stationary during the movement of the ram.

51. In a combination as set forth in claim 50, an additional amount of the endothermic material being initially disposed within the ram, before the movement of the ram in the particular direction, at a position interior in the ram to the exothermic material and being stationary during the movement of the ram.

52. In a combination as set forth in claim 50, the endothermic material being selected from a group consisting of a hydroxide and a hydrate to produce water molecules upon decomposition, the exothermic material including an oxidizer constituting a perchlorate.

53. In a combination as set forth in claim 52, the exothermic material also including a material constituting a binder and a reducing agent.

* * * * *